US006482293B1

(12) United States Patent
Ahvenniemi

(10) Patent No.: US 6,482,293 B1
(45) Date of Patent: Nov. 19, 2002

(54) METHOD AND DEVICE IN TAIL THREADING

(75) Inventor: Vesa Ahvenniemi, Helsinki (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/402,987

(22) PCT Filed: Feb. 15, 1999

(86) PCT No.: PCT/FI99/00119

§ 371 (c)(1),
(2), (4) Date: Jan. 10, 2000

(87) PCT Pub. No.: WO99/41451

PCT Pub. Date: Aug. 19, 1999

(30) Foreign Application Priority Data

Feb. 13, 1998 (FI) ..... 980332

(51) Int. Cl.[7] ..... D21F 7/00
(52) U.S. Cl. ..... 162/193; 162/255; 226/92
(58) Field of Search ..... 162/193–195, 162/283, 286, 255, 359, 360.1, 232; 226/7, 91, 97.3, 92; 34/114, 117, 120

(56) References Cited

U.S. PATENT DOCUMENTS

| | | | | | |
|---|---|---|---|---|---|
| 4,087,319 | A | * | 5/1978 | Linkletter | 162/113 |
| 4,491,503 | A | * | 1/1985 | Adams et al. | 162/232 |
| 4,904,344 | A | * | 2/1990 | Peiffer | 162/193 |
| 5,037,509 | A | * | 8/1991 | Wedel | 162/286 |
| 5,158,648 | A | * | 10/1992 | Weldon | 162/193 |
| 5,762,759 | A | * | 6/1998 | Wedel | 162/193 |
| 6,073,825 | A | * | 6/2000 | Hilker | 226/91 |

* cited by examiner

*Primary Examiner*—Jose Fortuna
(74) *Attorney, Agent, or Firm*—Steinberg & Raskin, P.C.

(57) ABSTRACT

The invention relates to a method in tail threading, in which a lead-in strip, tail (T) separated from the edge of a paper web is guided between two elongated mobile means in a paper web conveying machine and transferred forward between these two means along a given portion in the machine direction of the machine. The mobile means are belts (1, 2) between which the tail is transported. The neutral axes (N) of the belts (1, 2) are substantially on the same level.

9 Claims, 2 Drawing Sheets

METHOD AND DEVICE IN TAIL THREADING

FIELD OF THE INVENTION

The invention relates generally to paper manufacturing or the like. More particularly, the invention relates to an improved method and device for tail threading.

BACKGROUND OF THE INVENTION

When starting a paper machine after a stoppage or a web break, the paper has to be passed through the machine again. Thus, a narrow edge strip is first separated from the edge of the paper web and run through the machine. After the edge strip has been made to travel through the machine or a machine section, it can be spread to a full-width web. There are various guide systems available to make the edge strip follow the travel path formed by cylinders and rolls. Generally, in that case, rope systems, so-called threading ropes, are used, which travel outside the edge of the paper web, the lead-in strip or tail being guided in between the ropes.

For example the Finnish patents 72549 and 89288 illustrate how the tail is guided after its cutting point into a gap formed by two threading ropes to pass the tail through a particular section in the longitudinal direction of the machine.

For example the process of passing the tail through multi-roll calenders sets high requirements for the threading system at high threading speeds. It can be estimated that rope threadings are suitable at speeds up to ca. 1500 m/min. At higher speeds, the narrow tail cannot be held between two adjacent ropes or cords without problems. For example, the tail is easily detached or broken when it hits parts located along its path, e.g. the shields of the threading ropes.

The purpose of the invention is to eliminate the above-presented drawbacks and to present a method which can be used in any section of a paper machine or an after-treatment machine for paper for reliable tail threading even at high threading speeds. The purpose of the invention is further to present a method which is advantageous especially in on-machine threadings of fast-running paper machines. To attain this purpose, the method for tail threading, according to the present invention, two belts are utilized which are guided against each other in such a way that the tail remains in between their surfaces. The neutral aces of the belts are substantially on the same level in the belt pair, wherein even in threadings along a tortuous path it is possible to avoid chafing of the tail. Furthermore, it is possible to utilize the shaping of the surfaces of the belts for locking the tail.

OBJECTS AND SUMMARY OF THE INVENTION

The device for attaining the objective of the invention is, in turn, characterized in what will be presented in the characterizing part of the appended claim 5. Both elongated means of the threading device are belts, wherein their surfaces which are placed against each other can be utilized to support the tail, and the neutral axes of the belts placed against each other are substantially on the same level. The belts may also be provided with formed portions, such as portions located at fixed intervals in the longitudinal direction, by means of which portions it is possible to lock the tail in a reliable manner to travel along with the belt.

BRIEF DESCRIPTION OF THE DRAWINGS

In the following, the invention will be described in more detail with reference to the appended drawings in which.

DETAILED DESCRIPTION OF THE INVENTION

Figure 1:
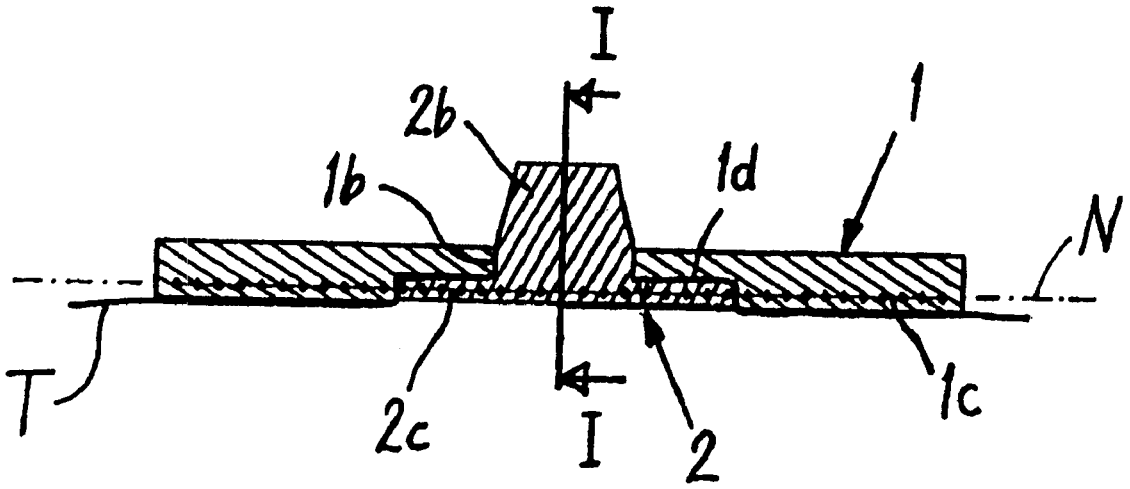
FIG. 1 shows a first embodiment of the threading device according to the invention in a cross-section perpendicular to the travel direction of the belt.
Figure 2:
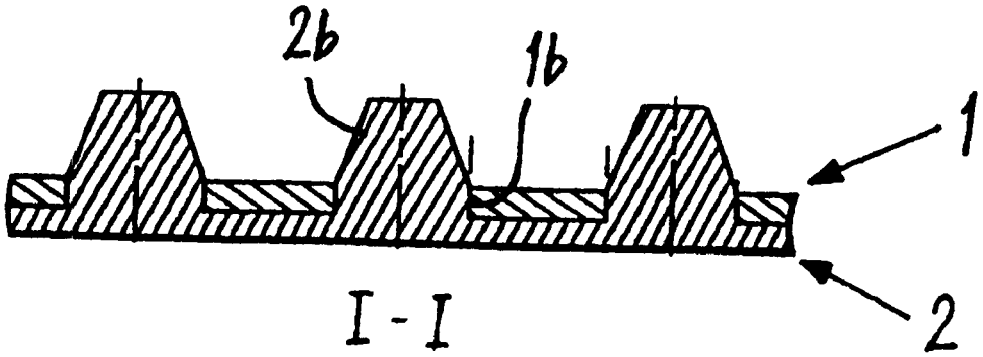
FIG. 2 shows the embodiment according to FIG. 1 in a longitudinal section along line I—I.

FIGS. 1 and 2 show a cross-section and a longitudinal section of the belts 1 and 2 used for threading. The belts which are placed against each other, a lead-in strip or tail T travelling between them, are provided with formed portions which fit to each other and will be described in more detail hereinbelow.

Between superimposed belts whose neutral axes are on different levels, sliding takes place at the turning points of the belt packet, chafing the tail and tending to disengage it from the transport. This phenomenon can be reduced by using belts whose neutral axes N coincide when the belts are placed on top of each other as shown in FIG. 1. Such a belt pair functions like one integral belt, and the belts do not have tendency to move with respect each other when the belt pair is bent. The neutral axis refers to that plane or, seen in the lateral direction, to that longitudinal line whose length remains substantially unaltered when the belt travels along a curved path.

In the embodiment shown in FIGS. 1 and 2, the belts differ in width. The narrow belt 2 is provided with a sparse cogging which constitutes formed portions 2*b* located at fixed intervals in the longitudinal direction. The wide belt 1 is provided with openings, which constitute formed portions 1*b* that mesh with the cogging, the teeth or cogs of the narrow belt 2 emerging through the openings. The narrower belt 2 is also accommodated in a recess 1*d* in the surface of the wider belt 1, the recess 1*d* being made approximately along the centre of the continuous belt material, and the thickness of the narrower belt corresponds to the depth of the recess 1*d*, wherein the surfaces of the belts are brought on the same level. The neutral axes N of both belts are brought on the same or approximately on the same level, and a reinforcement extending at this point is indicated with the reference numerals 1*c*, 2*c*. The cogging of the narrow belt 2 provides a guidance for the correspondingly cogged belt sheaves along the middle portion of the belt. Side flanges are thus not required in the belt sheaves. By means of the cogging, it is also possible to transmit the motion force from the belt sheave to the belts when necessary.

Figure 3:
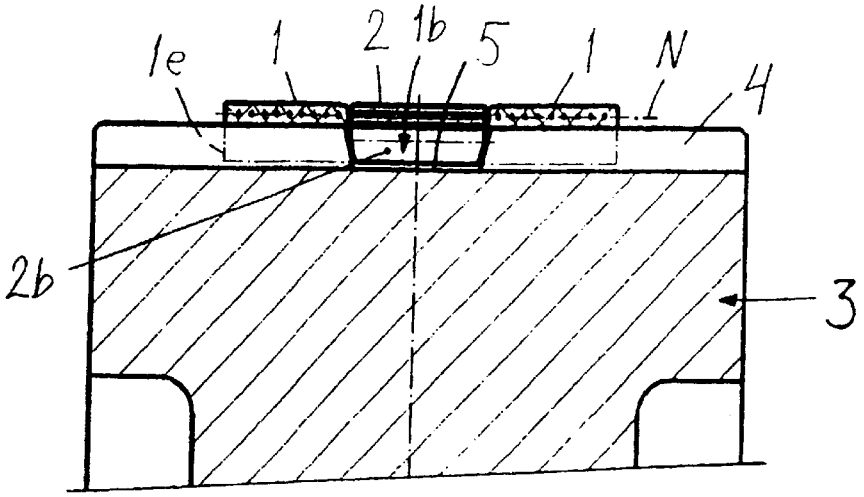
FIGS. 3 and 4 show cross-sections of a belt pair and a belt sheave slightly modified from the alternatives of FIGS. 1 and 2.
Figure 4:
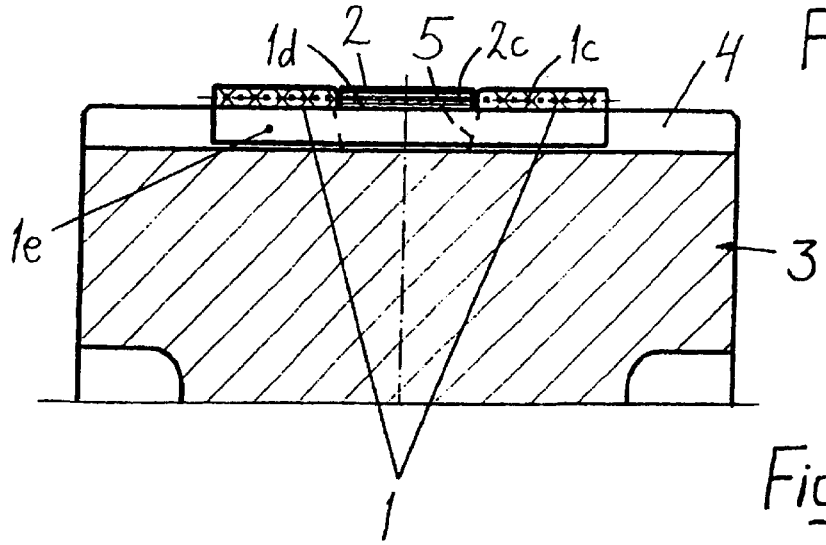

FIGS. 3 and 4 show a second belt pair applying the idea of a cogged belt, and the parts of the belt pair which function in a corresponding way are marked with the same reference numerals as in FIGS. 1 and 2. Here, similarly to FIGS. 1 and 2, there is also a narrower belt which is located substantially symmetrically in the middle of the wider belt. Here, in the middle of the cogging 4 of the belt sheave 3 there is a groove 5 in the peripheral direction, i.e. the teeth of the cogging consist of two parts. A tooth 2*b* of the narrower belt 2 is received in the groove between the parts. On both sides of the tooth 2*b* in the peripheral direction, i.e. in front of and behind the tooth, there is respectively a wider tooth 1*e* of the wider belt 1 which connects the longitudinal belt halves formed each of continuous belt material and located on the edges of the wider belt. The wider teeth 1*e* are received between the teeth in the cogging 4 of the belt sheave 3 thereby transmitting the motion force from the belt sheave 3 to the belt pair when necessary. The wider belt 1 is thus provided with a recess 1*d* which is defined by the belt halves in the lateral direction and by the wider teeth 1*e* from underneath. Successive openings 1*b* are formed in the wider belt 1 in the gaps between the successive wide teeth 1*e*. Also in this alternative, belt sheaves equipped with flanges are not required, because the teeth 2*b* of the narrower belt 2 guide the entire belt pair when received between the tooth parts of the belt sheave. The belt materials of the belt halves in the wider belt 1 and the narrower belt 2 are approximately equal in thickness, wherein the surfaces on the side opposite to the cogging are on the same level.

When the invention is used for example in a paper machine or a coating machine, or in another after-treatment machine for paper, the belts 1, 2 are introduced in the place of present threading ropes. Both belts are adjoined into a loop after being threaded in the machine. The belts can be pulled with known traction devices and tightened with known tensioning devices. The belts can be shielded with C-chutes in every roll interspaces and free spaces. At the change points, the belts are separated from each other in a short distance by means of belt sheave arrangements.

The tail is blown, sucked or transported in another suitable way into a gap formed in the adjoining point of the belt loops. When the belt is moving at the web speed, the strip is automatically pressed between the belts after travelling through the nip located at the end of the gap. The fixation of the tail is increased by the formed portions located in the supporting surfaces of the belts, such as the teeth 2*b* according to the figures, piercing the tail at the openings. The fixation of the paper strip set between the belts is substantially better than that of a paper running between two adjacent cords. Good fixation of the tail also enables a shielding of the belt everywhere for example by means of a C-chute or another protective structure.

The speed of the belt can be adjusted accurately to a speed prevailing during the transport of the tail in a paper machine, coating machine or another after-treatment machine, because the belt is arranged to be of the cogged belt type, and thus it will not slide with respect to the belt sheaves under any conditions.

Figure 5:
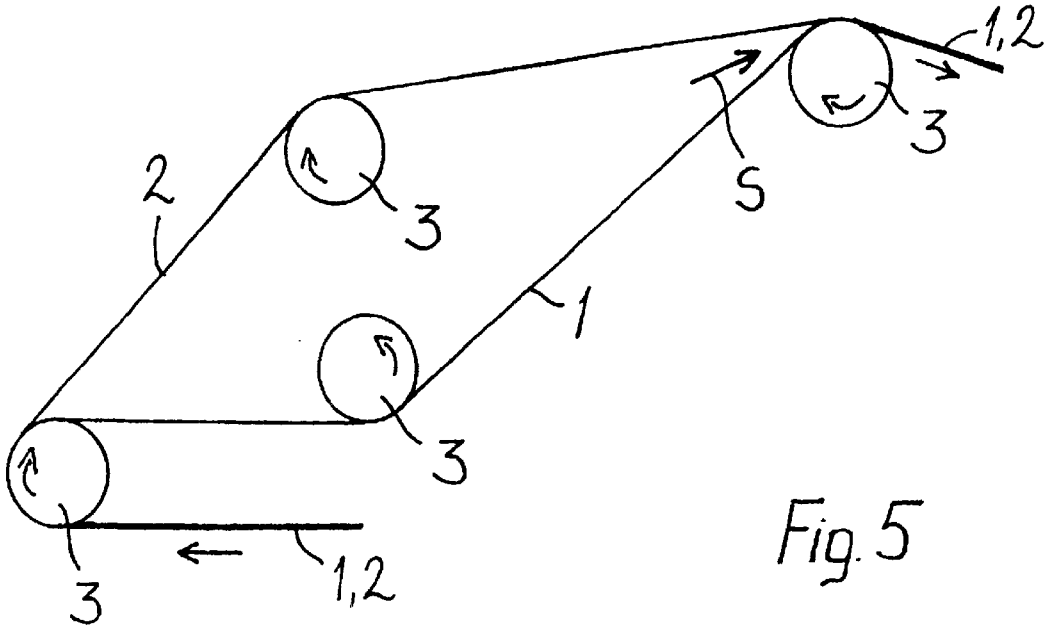
FIG. 5 illustrates a running path of the threading means in a side view of the machine.

The end of the tail T is guided between the two belts 1, 2 within a distance of few meters in such a way that a sufficiently firm grip on the tail is attained. Thus, the travel of the two-ply belt through a particular section of the machine closely follows the travel of the paper web. At that point where the tail is transferred to the next section, the belts, according to one alternative, diverge from each other and return along routes of their own to the starting point, thus each forming a belt loop. According to another alternative, the belts do not diverge from each other at the final point of the threading route, but the tail i.e. the edge strip is detached from the transport of the belts for example with a cutting means set next to the belts, which cutting means is either a mechanical blade device or a blow nozzle which transfers the detached edge strip to other conveyors of the edge strip or to the reel spool in a reel-up. In this embodiment, the belts are passed together back to the starting point of the threading route, and it is not until short before the point of entrance of the tail between the belts that the belts are detached from each other. Thus, also in the return route, the belts can be advantageously conveyed with common guide means. This possibility is illustrated in FIG. 5, in which the belts 1, 2 are passed onto the belt sheave 3 together, after which they diverge from each other as guided by their own belt sheaves 3, and after these belt sheaves the belts are guided together again by means of a belt sheave 3. The tail is passed in the direction of the arrow S into a gap, i.e. the starting point of the threading route, which closes in a wedge-like manner and is located before this last belt sheave 3. The belts 1, 2 can be located off the normal travel path of the paper web, and the tail can be guided between the belts for example by means of pressurized air with known methods used in connection with rope threadings.

The belts can be used for threading of the tail along suitable portions of the paper machine. It is, for example, possible to utilize belt transport from the last drying cylinder of the drying section through the calender section to the reel-up, but the invention is not restricted solely to particular portions of the paper machine. Besides paper machines, the invention is applicable to other machines conveying the paper web in which guidance of the tail is necessary. Similarly, the term "paper web" refers to all continuous materials made of fibrous raw material irrespective of the grammage.

The width of the belts can be dimensioned according to the width of the tail. In both belts, the surfaces of continuous belt material are located at least partly within the width of the tail. Both belts 1, 2 can be narrower than the tail T, because by means of a wide supporting surface it is possible to produce a good hold. In the threading, an approximately 15 to 50 cm wide tail is thus passed along its middle portion between the belts, and both edges of the tail can run freely. The edges of the tail can also be located inside the edges of the wider belt.

In this context, the term "belt" refers to an elongated means with a sufficiently wide supporting surface for supporting the tail in such a way that the tail is placed against the belt within this width. In this position, the supporting surface of the belt is parallel to the plane of the web. Furthermore, the thickness of the belt profile in the area between the possible teeth is advantageously smaller than the width of the supporting surface, wherein the belt bends well to comply with the travel of the web.

As a material for elongated belts, it is possible to use a suitable flexible and durable material which is well adaptable to different types of threadings, for example elastomer.

What is claimed is:

1. A method for tail threading in a paper web conveying machine which comprises:

providing first and second belts running a selected distance of their travel separated from one another along independent paths;

separating a tail section from an edge of a paper web;

guiding the tail section between the first and second belts arranged in face to face relationship and said first belt being provided with means for receiving said second belt, said first and second belts being adapted to travel conjointly in an operative direction of said paper web conveying machine so that said tail section situated between said belts is drawn by said first and second belts in said operative direction;

said first belt having a first thickness and said second belt having a second thickness, said first belt having a neutral plane and said second belt having a neutral plane, said means for receiving said second belt being structured and arranged so that when said second belt is received by said first belt said neutral plane of said first belt is substantially aligned with said neutral plane of said second belt.

2. The method according to claim 1, wherein said second belt is provided with a plurality of protruding formed portions and said first belt is provided with a plurality of corresponding through holes adapted to receive said portions.

3. The method according to claim 2, wherein said protruding formed portions are adapted grasp said tail when said tail is inserted between said first and second belts.

4. The method according to claim 1, wherein said protruding formed portions are adapted to cooperate with a belt sheave.

5. A device for tail threading in a paper web conveying machine, said device comprising:

first and second belts arranged to run a selected section of their travel separated from one another along independent paths and arranged in face to face abutment outside said section, said first belt being provided with means for receiving said second belt, said first and second belts being adapted to travel conjointly in an operative direction of said paper web conveying machine and being structured and arranged to receive a tail section between said belts so that said tail section is drawn by said first and second belts in said operative direction;

said first belt having a first thickness and said second belt having a second thickness, said first belt having a neutral plane and said second belt having a neutral plane, said means for receiving said second belt being structured and arranged so that when said second belt is received by said first belt said neutral plane of said first belt is substantially aligned with said neutral plane of said second belt.

6. The device according to claim 5, wherein means for receiving said second belt comprises a recess in a surface of said first belt.

7. The device according to claim 6, wherein said second belt is provided with a plurality of protruding formed portions and said first belt is provided with a plurality of corresponding mating structures adapted to cooperate with said portions.

8. The device according to claim 7, wherein said protruding formed portions are arranged in spaced relation along a longitudinal direction of said second belt.

9. The device according to claim 7, wherein cooperating mating structures comprise one of recesses, openings and notches.

* * * * *